US007845421B2

(12) United States Patent
Braddick

(10) Patent No.: US 7,845,421 B2
(45) Date of Patent: Dec. 7, 2010

(54) DOWNHOLE TUBULAR EXPANSION TOOL AND METHOD

(75) Inventor: Britt O. Braddick, Harris County, TX (US)

(73) Assignee: TIW Corporation, Houston, TX (US)

( * ) Notice: Subject to any disclaimer, the term of this patent is extended or adjusted under 35 U.S.C. 154(b) by 305 days.

(21) Appl. No.: 11/803,389

(22) Filed: May 12, 2007

(65) Prior Publication Data

US 2008/0277111 A1 Nov. 13, 2008

(51) Int. Cl.
*E21B 23/00* (2006.01)
*E21B 43/10* (2006.01)

(52) U.S. Cl. ..... 166/384; 166/207; 166/380; 166/216

(58) Field of Classification Search ..... 166/207, 166/216, 380, 384, 217
See application file for complete search history.

(56) References Cited

U.S. PATENT DOCUMENTS 3,282,346 A * 11/1966 Claycomb ..... 166/182
3,746,091 A * 7/1973 Owen et al. ..... 166/107
3,948,321 A * 4/1976 Owen et al. ..... 166/277
5,333,692 A 8/1994 Baugh et al.
5,348,095 A 9/1994 Worrall et al.
5,355,948 A * 10/1994 Sparlin et al. ..... 166/228
6,021,850 A 2/2000 Wood et al.
6,041,858 A 3/2000 Arizmendi
6,050,341 A 4/2000 Metcalf
6,250,385 B1 6/2001 Montaron
6,622,789 B1 9/2003 Braddick
6,763,893 B2 7/2004 Braddick
6,814,143 B2 11/2004 Braddick
7,124,827 B2 10/2006 Braddick
7,124,829 B2 10/2006 Braddick
2001/0020532 A1 9/2001 Baugh et al.
2005/0056433 A1 * 3/2005 Ring et al. ..... 166/384
2008/0156499 A1 * 7/2008 Giroux et al. ..... 166/380

FOREIGN PATENT DOCUMENTS

RU 989038 * 1/1983

* cited by examiner

*Primary Examiner*—Shane Bomar
*Assistant Examiner*—Cathleen R Hutchins
(74) *Attorney, Agent, or Firm*—Browning Bushman P.C.

(57) ABSTRACT

A tool 10 is provided for radially expanding a downhole tubular C, and includes a central tool mandrel 12, a tubular expander 48 at the lower end of the tubular, and a downhole actuator 15 for forcibly moving the expander axially within the downhole tubular. Slips 20 are positioned for securing the tool within a well, so that the slips may be set, and the tool subsequently stroked to move the expander 48 and radially expand a length of the tubular. Upward pull on the work string may expand long portions of the downhole tubular. Buttress threads 43 preferably support the tubular expander on the downhole tubular when run in the well.

38 Claims, 9 Drawing Sheets

DOWNHOLE TUBULAR EXPANSION TOOL AND METHOD

FIELD OF THE INVENTION

The present invention relates to tools and techniques for expanding a tubular in a well. More particularly, the invention relates to a highly reliable tubular expansion tool which may be positioned downhole and hydraulically stroked to expand a relatively short length of the downhole tubular or pulled upward from the surface to expand a long length of the downhole tubular.

BACKGROUND OF THE INVENTION

One of the problems with prior art expansion tools is that the tubular expander itself is frequently housed within an outer tubular housing which inherently has a diameter greater than the diameter of the expander. Accordingly, it is frequently difficult to position this housing with the internal expander therein at the desired location at the lower end of the tubular in a well, particularly when there is a substantial variance between the OD of the tubular expander housing and the OD of the tubular prior to being expanded.

A further significant problem with conventional tubular expander techniques is that axial movement of the tubular expander must be stopped before reaching the upper end of the tubular being expanded, since an expander under high force will tend to "shoot past" the upper end of the tubular during the expansion process, thereby resulting in an unsafe condition. Accordingly, operators typically stop upward progress of the expander before the upper end of the casing being expanded, then lower the expander in the well, then use a cutting tool to separate the uppermost portion of the tubular string which is not expanded from the portion of the tubular string which is expanded. Once the expander is removed from the well, the cut-off upper portion of the tubular string may be similarly removed from the well.

Various hydraulic expansion tools and methods have been proposed for expanding tubular while downhole. While some of these tools have met with success, a significant disadvantage to these tools is that, if a tool is unable to continue its expansion operation (whether due to the characteristics of a hard formation about the tubular, failure of one or more tool components, or otherwise), it is difficult and expensive to (a) retrieve the tool to the surface to repair the tool, (b) utilize a more powerful tool from the beginning to continue the downhole tubular expansion operation, or (c) sidetrack around the stuck expander. Accordingly, techniques have been developed to expand a downhole tubular from the top down, rather than from the bottom up, so that the tool may be more easily retrieved.

U.S. Pat. No. 5,348,095 discloses a method of expanding a casing downhole utilizing a hydraulic expansion tool. U.S. Pat. No. 6,021,850 discloses a downhole tool for expanding one tubular against either a larger tubular or the borehole. Publication U.S. 2001/0020532 A1 discloses a tool for hanging a liner by pipe expansion. U.S. Pat. No. 6,050,341 discloses a running tool which creates a flow restriction and a retaining member moveable to a retracted position to release upon the application of fluid pressure. U.S. Pat. No. 6,250,385 discloses an overlapping expandable liner. A high expansion diameter packer is disclosed in U.S. Pat. No. 6,041,858. U.S. Pat. No. 5,333,692 discloses seals to seal the annulus between a small diameter and a large diameter tubular.

The disadvantages of the prior art are overcome by the present invention, and an improved tool and technique are hereafter disclosed for expanding a downhole tubular.

SUMMARY OF THE INVENTION

In one embodiment, a tool for radially expanding the downhole tubular includes a tubular expander having a tapered outer surface for expanding the downhole tubular as the expander moves axially. A downhole actuator moves the expander axially within the downhole tubular. Buttress threads may support the tubular expander from a lower end of the downhole tubular when the downhole tubular and expander are run in the well, with the buttress threads having a tension flank that is angled downwardly and outwardly with respect to a central axis of a tool. The buttress threads release the tubular expander to move upward with respect to the downhole tubular.

In another embodiment, the tool includes a slip assembly positioned above the tubular expander for securing the tool to a downhole tubular. The tool may be picked up at the surface through the work string to release the slips after an expansion stroke. In a preferred embodiment, the downhole actuator includes a hydraulically powered drive assembly for separately setting the slips and later moving the expander axially within the downhole tubular. Improvements allow the expander to reliably move through the upper end of the tubular being expanded, since slips secure the tool axially within the well during this final expansion.

These and further features and advantages of the present invention will become apparent from the following detailed description, wherein reference is made to the figures in the accompanying drawings.

DETAILED DESCRIPTION OF PREFERRED EMBODIMENTS

FIG. 1 illustrates one embodiment of a expansion tool 10 which may be used to expand a liner, casing, or other tubular C within a well. FIG. 1, as well as other figures discussed below, is provided with upper assembly A and lower assembly B. The tubular C and the tool may be run and the tubular expanded in an uncased portion of a well, or may be run in a cased portion of a well. A particular feature of the invention is the use a downhole actuator 15, which may be hydraulically powered, to expand one or more relatively short portions of the tubular C. Thereafter, the secured engagement of the expanded portion of the tubular with the well (either an outer casing or the borehole wall) allows an axial pull on the work string which run the tool in the well to pull up on the tool and thus upon the expander to thereby expand a relatively long portion of the tubular C.

Figure 1A:
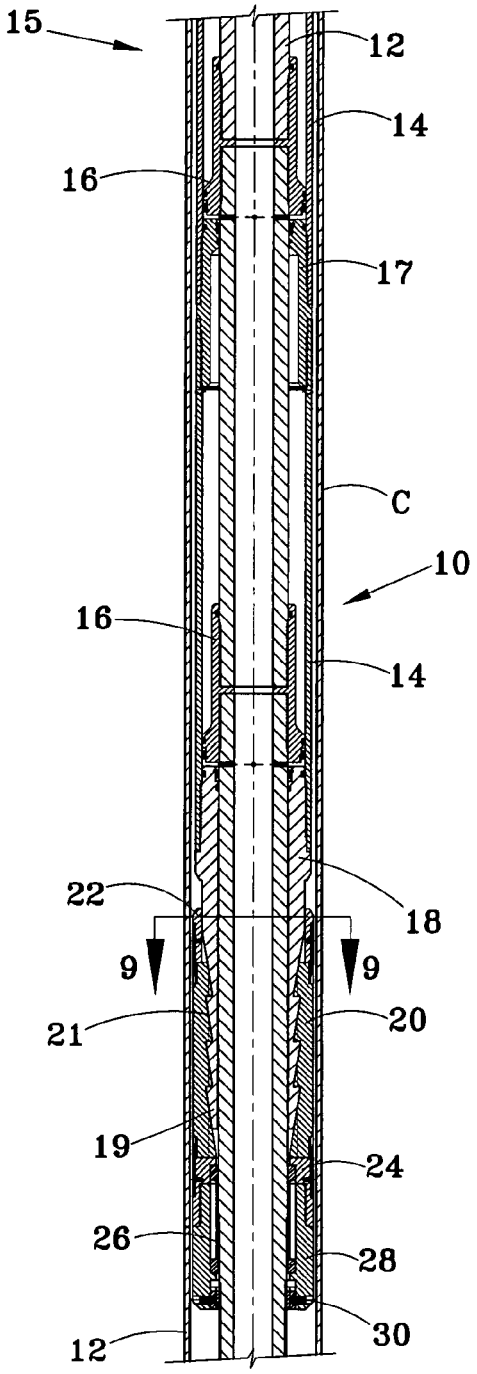
FIGS. 1A and 1B are cross-sectional views of a portion of an expansion tool positioned within a downhole tubular.
Figure 1B:
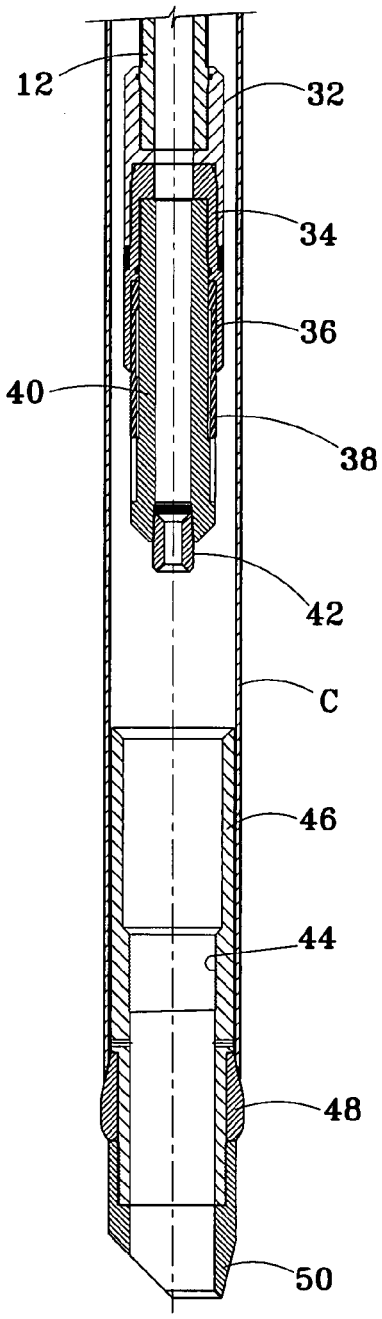

FIGS. 1A and 1B illustrates a representative portion of a drill pipe or other work string 12 which supports a tool including an actuator 15 having a plurality of pistons 16 each connected to the inner sleeve 12, and axially sealed to the outer sleeve 14. The pistons 17 are each sealed to the mandrel 12, and are axially fixed to the outer sleeve 14. The pistons, which act to stroke the tool, are mechanically coupled to sections of the outer sleeve 14, to axially move to the outer sleeve 14. In a preferred embodiment, the downhole actuator 15 comprises a plurality of pistons each axially movable in response to fluid pressure. The actuator 15 is thus preferably double acting, exerting a downward force on the outer sleeve 14 to set the slips, and simultaneously an upward force on the mandrel 12 to move the expander through the tubular. In a preferred embodiment, one or more of the plurality of pistons is radially inward of another of the plurality of pistons when the downhole actuator is fully stroked, thereby minimizing the axial length of the actuator. The downhole actuator generates an axial setting force to set the slips, and subsequently generates an axial tension force to radially expand the downhole tubular. The same hydraulic stroking action of the tool may thus be used to set the slips and to expand a length of the downhole tubular. Further detail regarding a suitable hydraulic downhole actuator are disclosed in U.S. Pat. Nos. 7,124,829, 7,124,827, 6,814,143, 6,763,893, and 6,622,789.

The tubular C with expander 48 at a lowermost end thereof may first be run in a well. The tool 10 as shown in FIGS. 1A and 1B may thus be run in the well after the tubular C and expander 48 are in the well, with the tool run to a selected distance above sleeve 46, which as shown has threads 44 on its interior surface of a restricted diameter portion. End sleeve 50 is threaded to the lower end of sleeve 46, and the wedge ring or other suitable expander 48 having a tapered outer surface is effectively sandwiched between the lowermost end of the casing C and the upper end of end sleeve 50.

Figure 9:
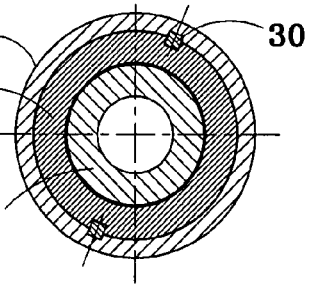
FIG. 9 illustrates a cross-sectional view along lines 9-9 in FIG. 1A.

The tool includes a setting sleeve 18 which is mechanically connected to the outer sleeve 14, and supports one or more members 19 which press the slips 20 outward when the setting member is moved downward by the actuator 15. An upper guide sleeve 22 is provided encompassing the slips 20, and is also shown in FIG. 9.

Figure 2A:
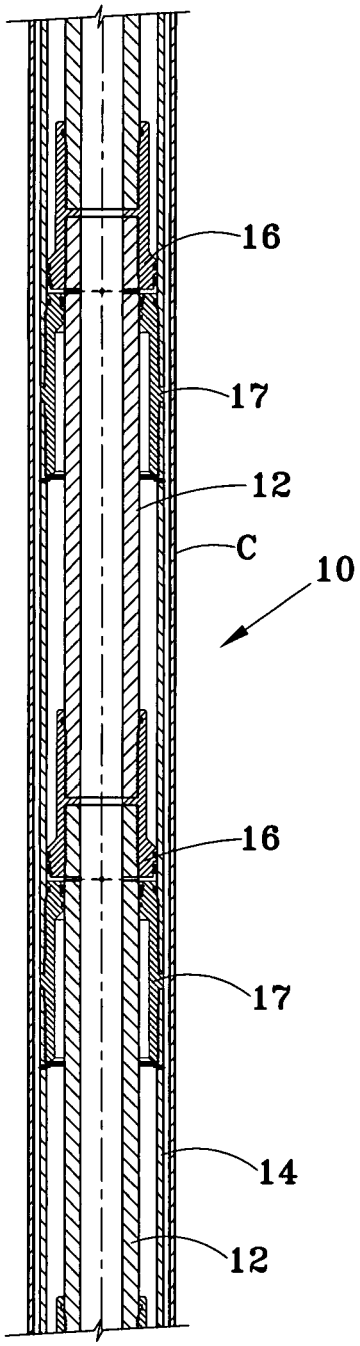
FIGS. 2A and 2B illustrate the downhole tubular and tool shown in FIG. 1 with the tool secured to the downhole tubular.

FIG. 2A illustrates the piston assembly and the slip setting assembly lowered so that the seals 35 are in sealing engagement with the sleeve 46. Left-hand threads 38 and 44 as shown in FIGS. 1A and 1B and FIGS. 2A and 2B allow for latching of the tool with the sleeve 46 supported on the lower end of the tubular. In this position, the threads 38 supported on the collet member 36 as shown in FIG. 1B latch with the threads 44 on a sleeve 46 to securely latch the tool 10 within a lower end of the casing C. These left-hand threads allow right-hand rotation of the work string, if necessary, to disengage the tool from the downhole expander.

Slips 20 are prevented from moving downward due to engagement of the slips with the ring 28. Cage 24 is threaded to the ring 28, with collet mechanism 26 between the OD of mandrel 12 and the ID of ring 28. Ring 28 thus includes suitable windows, each for receiving a respective slip. Collets 26 include upper and lower heads 29, and cooperate with a groove or other stop surface 25 on the mandrel 12 to prevent the slips from moving downward with the outer sleeve 14 during a slip setting operation. Keys 30 are provided at the lower end of ring 28, and slide within slots 29 provided in the mandrel 12 to limit relative rotation between the ring 28 and the mandrel 12. The keys 30 are also shown in FIG. 9. Once the slips are set, the mandrel 12 may be moved upward relative to the slips during the tubular expansion operation, as shown in the figures.

Figure 2B:
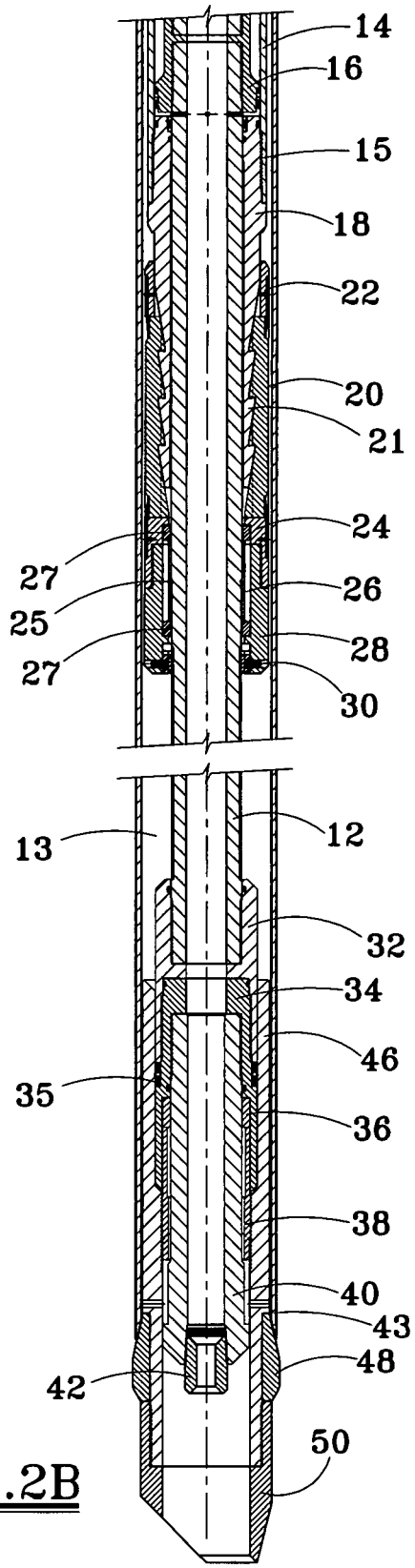

Fluid may thus be transmitted down the interior of the drill pipe (work string) and the mandrel 12, and may then be discharged from the choke 42, as shown in FIG. 2B. Vent port 43 is provided for venting between the annulus 13 surrounding the mandrel 12 and internal of tubular C. From the FIG. 1 position to the FIG. 2 position, the work string and the downhole actuator 15 are lowered relative to the tubular C to latch the tool to the expander sleeve 46.

Figure 3A:
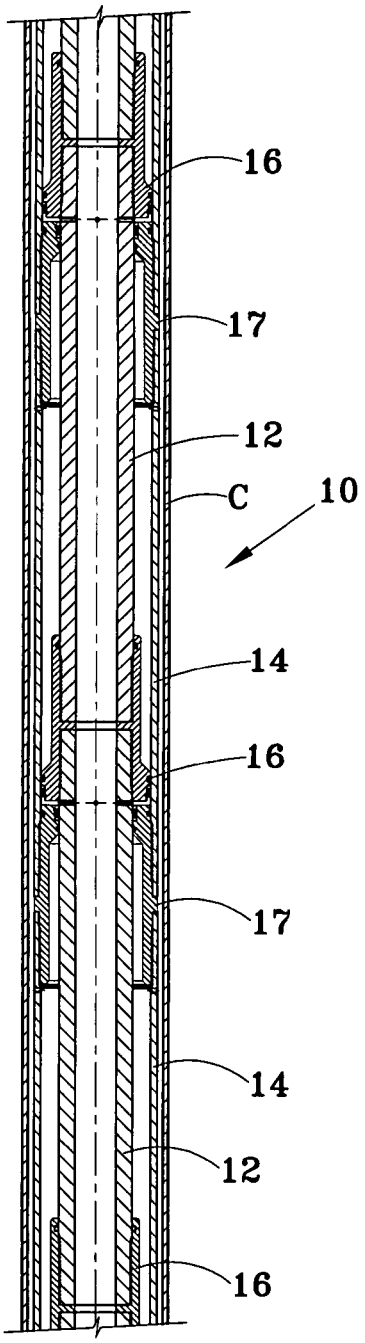
FIGS. 3A and 3B illustrate the downhole tubular and tool shown in FIG. 1 at a desired setting depth.
Figure 3B:
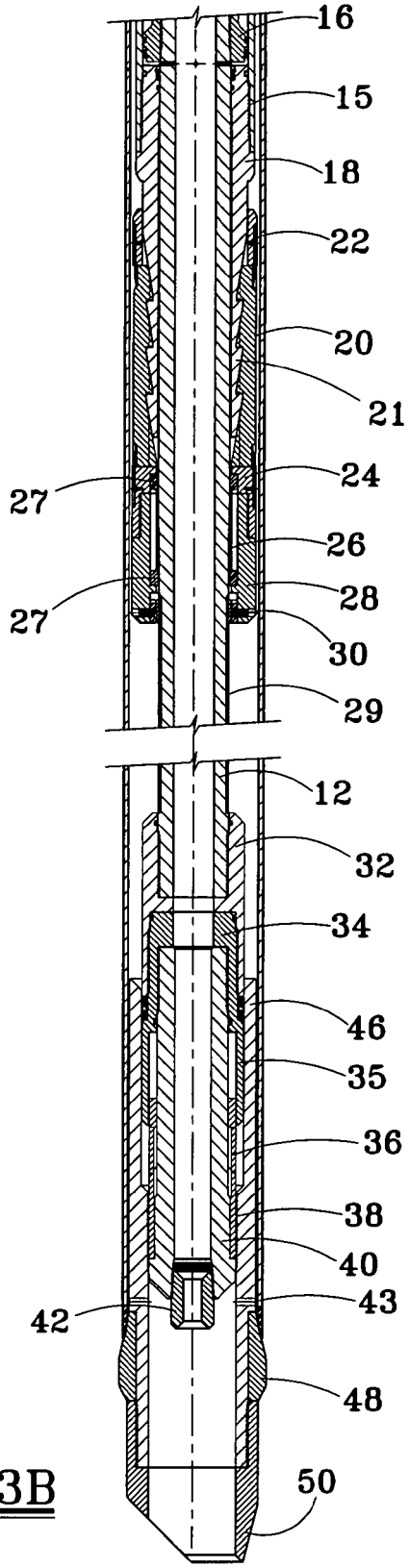
Figure 4:
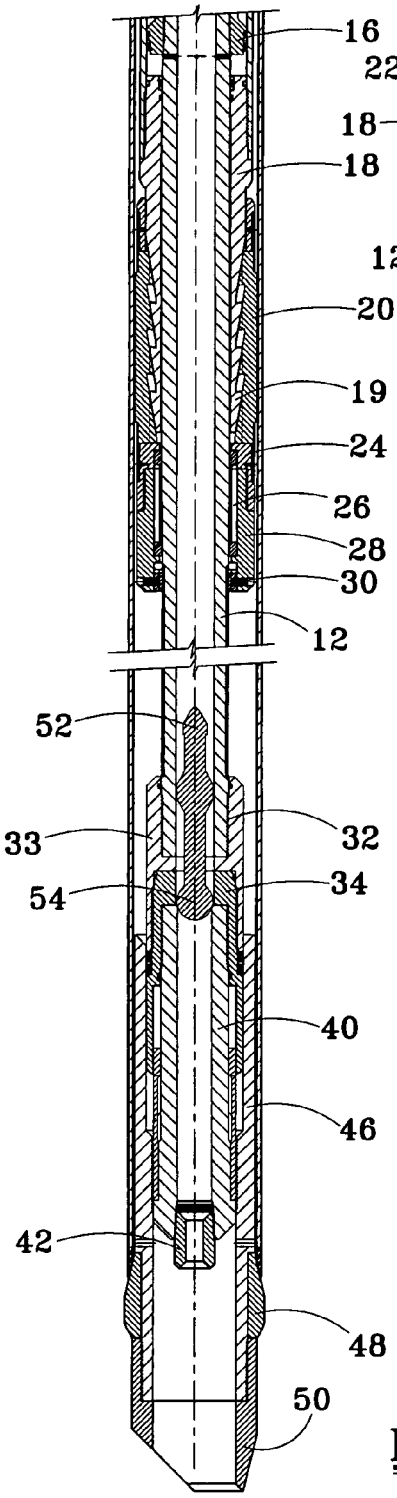
FIG. 4 illustrates the downhole tubular and tool with the ball landed to set the slips.

In FIGS. 3A and B, the casing C with the tool latched or otherwise secured thereto is run to a desired setting depth in the well. The entire tool may be picked up a short distance at the setting depth, with both the collets 26 discussed below and the slips 20 moving upward, and ports 43 then positioned below mandrel 40. The lower end 35 of seat sleeve 34 thus bottom out on the shoulder on sleeve 46 in FIG. 2B, but are raised with the mandrel 12 in FIG. 3B. FIG. 4 illustrates the lower end of the tool with a seated ball 54, which alternatively may be a plug, dart, or other closure, optionally with an upper fish neck end 52 for retrieving the ball, if necessary. The ball 54 thus lands on the mandrel 40, thereby allowing for pressure in the mandrel 12 above the seated ball to be increased. Threads 32 connect the mandrel 12 to the coupling 33, which is threaded to seat sleeve 34. Mandrel 40 is also threaded to the seat sleeve 34, and supports the choke 42.

The setting of the slips may be accomplished by setting the ball to raise the internal pressure in the mandrel 12 until the increased pressure forces the pistons 17 downward relative to pistons 16, thereby providing a high axial force to drive the setting member 18 downward. The cam surfaces on the cones 19 are driven downward relative to mating surfaces on the slips 20, forcing the slips radially outward to engage the casing C. Since a plurality of pistons are provided, the setting pressure may be relatively low for anchoring the slips and for moving the expander through the downhole tubular.

Figure 5A:
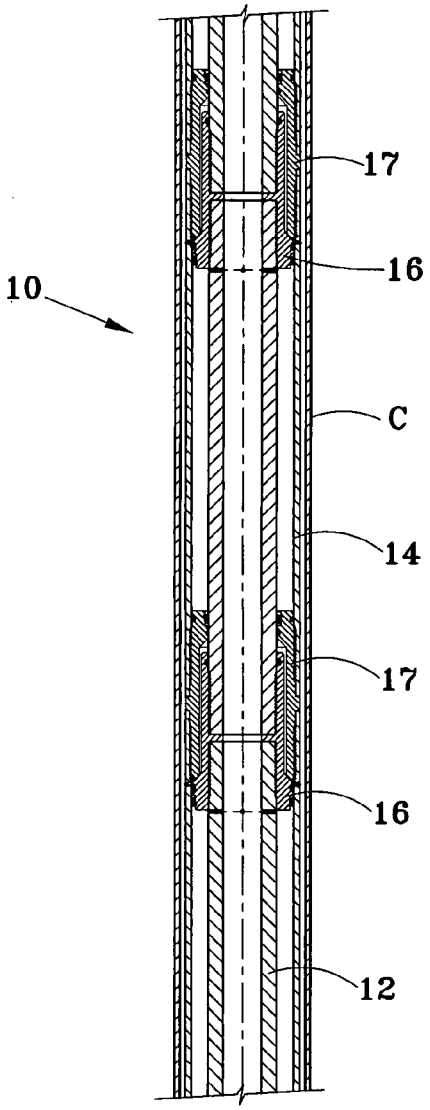
FIGS. 5A and 5B illustrate the tool expanding a first stage of the downhole tubular.
Figure 5B:
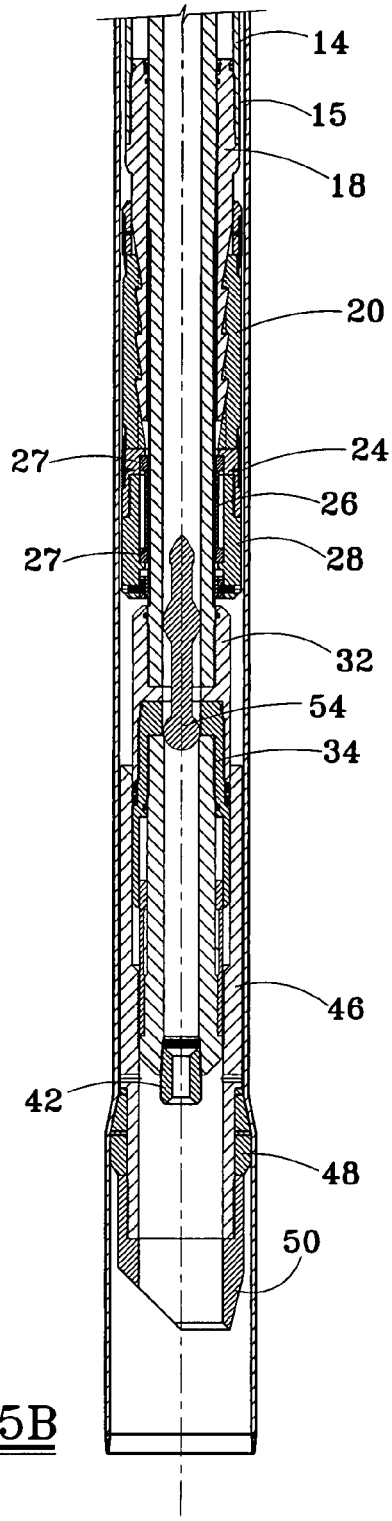

FIGS. 5A and 5B illustrate the tool hydraulically activated to expand a first portion or stage of the tubular C. Movement of the pistons 16 and thus the mandrel 12 relative to piston 17 and sleeve 14 pulls the mandrel 12 upward, typically in the range of from 2 to 10 feet, so that the plug 54 and seat sleeve 34 are shortly below the lower end of the ring 28. During expansion of the first stage of the tubular C, the mandrel 12 moves upward within a length of the other sleeve 14, and maintains sealed engagement during its stroking operation with the outer sleeve 14, with the seal optionally being positioned for sealing with an intermediate sleeve fixed to either the outer sleeve 14 or the inner mandrel 12.

In many applications, the lower end of the tubular will be reliably secured within a cased or uncased well with a tubular expansion of only 5 to 30 feet. The tool may be secured with less axial expansion if expanded into engagement with a cased well. Once the lower end of the tubular has been expanded in this manner, a substantial upward force may be applied to the drill pipe at the surface (slips are unset), which is then transmitted through the mandrel 12 of the tool to the expander 48, thereby expanding the tubular C. A force of approximately ¼ to 1 million pounds may thus be sufficient to expand a casing or other tubular from an ID of approximately 8.9 inches to an ID of approximately 10.3 inches. Moreover, the tubular may be expanded within a hole cased by larger diameter tubular, or the tubular may be expanded in an open hole.

Figure 6A:
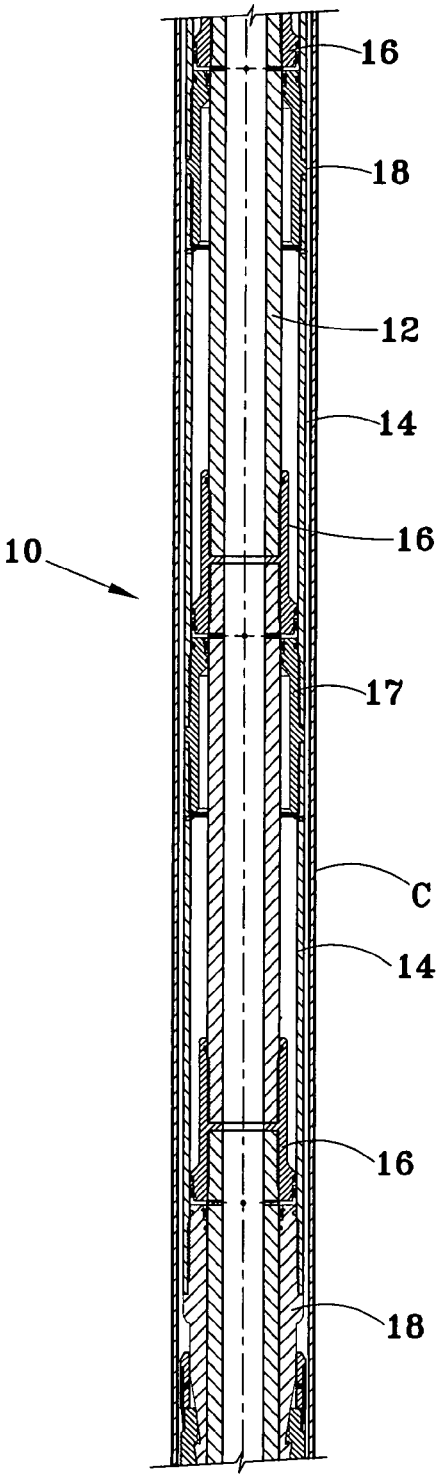
FIGS. 6A and 6B illustrate the tool in a retracting stroke after expanding a first stage.
Figure 6B:
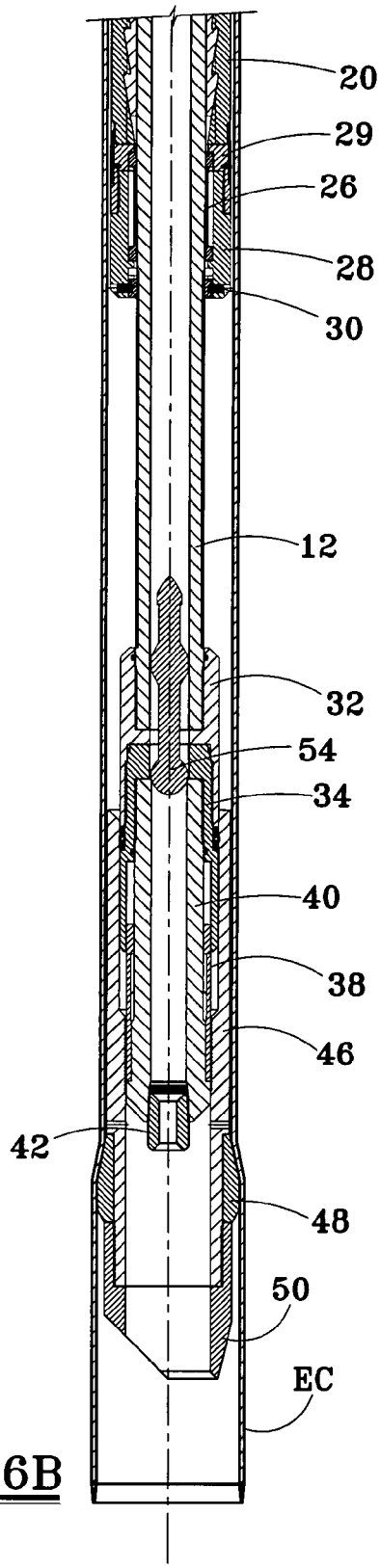

FIGS. 6A and 6B illustrate the tool 10 restroked to its initial position after the first stage expansion. During this operation, the slips are deactivated and the work string and thus the outer sleeve 14 are pulled upward a sizable length of several feet or more for another stroking operation. After stroking the tool as shown in FIGS. 6A and 6B, the slips 20 may again be set, the tool stroked during a second stage expansion, and the process repeated as desired.

Figure 7A:
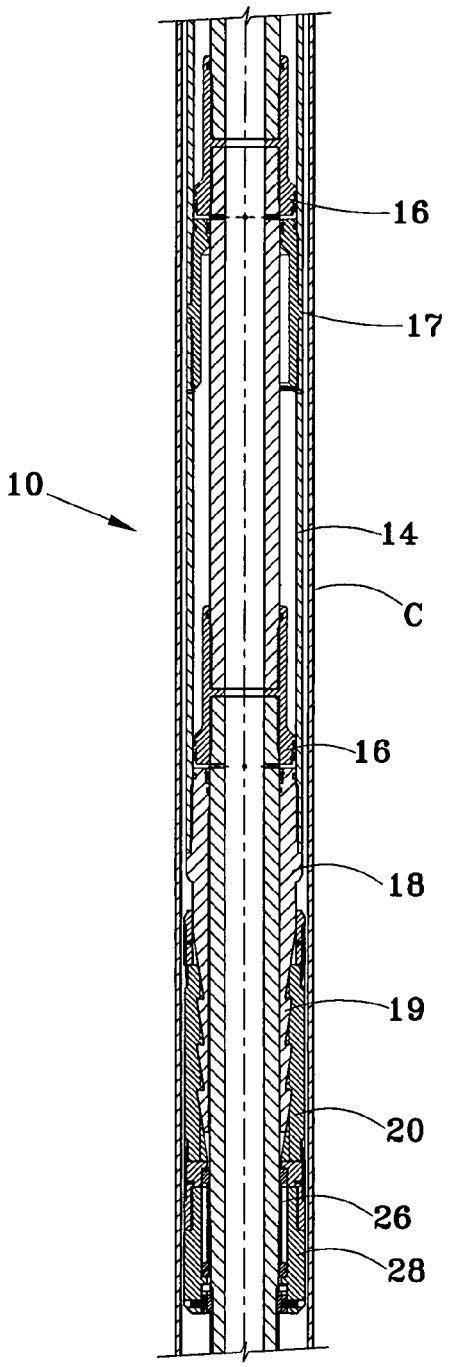
FIGS. 7A and 7B illustrate the tool with the slips set to expand the second stage of the downhole tubular.
Figure 7B:
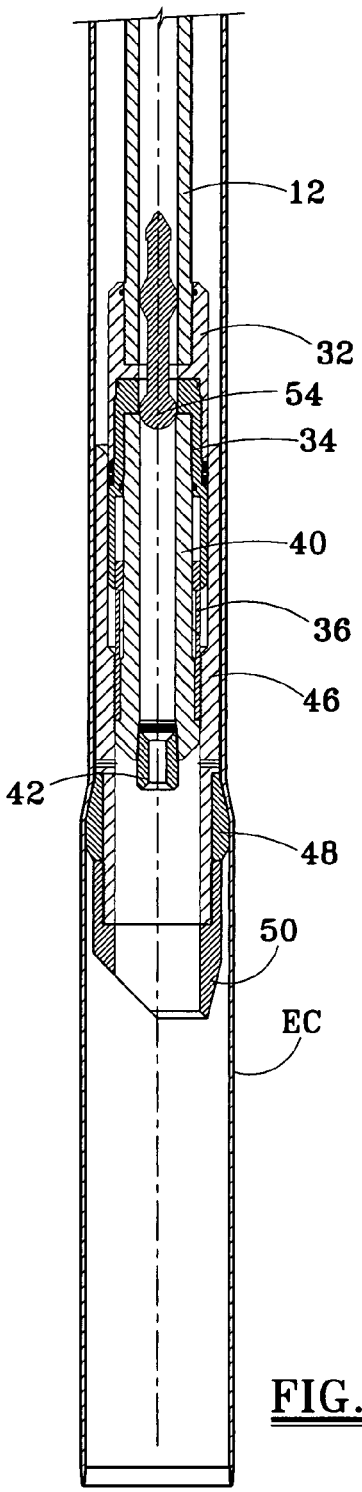

FIGS. 7A and 7B show a completed second stage expansion and retraction of the slips after the tool is again stroked. The slips 20 may thus be set in a well and the expander 48 moved upward in response to the downhole actuator 15. Also, if the expander were to become stuck in the tubular for some reason while expanding the tubular by applying tension to the drill string, and the tensile limits of the drill pipe and/or the drilling rig have been attained, the slips may be set and hydraulic pressure used to move the expander through the length of the stroke of the actuator. This process may be repeated several times, if necessary, to pass by the restriction.

FIG. 9 is a cross-sectional view along the lines 9-9 in FIG. 1, and illustrates the setting sleeve 18 circumferentially secured to the upper sleeve 22 by keys 30 to limit relative rotation between setting sleeve and upper sleeve.

Figure 10:
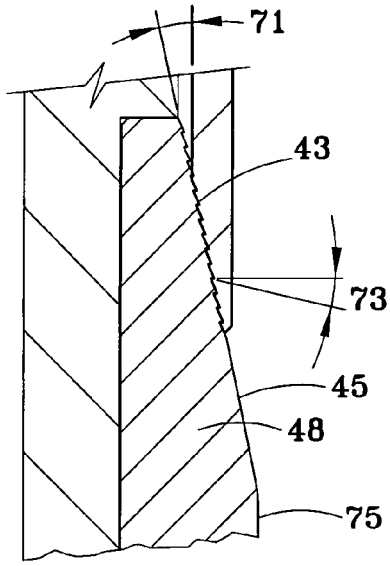
FIG. 10 illustrates in greater detail a preferred interconnection of the downhole tubular and the expander.

As shown in FIG. 10, a preferred expander has buttress threads 43 with a negative flank angle mechanically connecting the expander to a lower end of the tubular when run in the well. The buttress threads 43 as shown in FIG. 10 have a tension flank that is substantially perpendicular to or preferably is angled downwardly and radially outwardly at angle 73 with respect to a central axis of the tool. These buttress threads may safely support the tubular expander when run in the well and release the tubular expander to move axially upward with respect to the downhole tubular.

A radially outer surface 45 of the expander on which the threads 43 are formed is preferably at an angle 71 of from about 9° to about 15°, and preferably about 12°, for effectively accomplishing the desired expansion. Buttress threads preferably are at a negative angle or perpendicular to the tool central axis, meaning that the thread flanks extend radially outward and typically downwardly at a desired negative angle. A negative thread flank angle 73 is shown in FIG. 10. The expander 48 has a radially outermost surface, which may be part of a tapered surface or a short cylindrical surface 75, as shown in FIG. 10. This enables the expander to reliably attach to the tubular string, but also allows the expander to move upward past the threads when the hydraulic pistons of the downhole actuator are activated. Buttress threads are preferable for various uses over other techniques to mechanically support the expander at the lower end of the tubular. Shear pins, screws, and other mechanical connectors are less desirable since they or their receiving receptacles inherently cause stress points in the tubular, which when expanded can crack the expanded tubular, with that crack migrating upward as the expander moves upward.

In a preferred embodiment, the radial expander is a single ring-shaped member having an outer tapered surface, as discussed above. In other embodiments, the expander may comprise a plurality of collet heads at the end of collet fingers, such that the collet heads collectively form a radial expander when the collet heads are in an outward position, although the collet fingers may collapse to a reduced diameter position for retrieval. One embodiment of an expander formed from collet fingers and expander members is disclosed in U.S. Pat. No. 6,814,143.

A particular feature of the invention is that the work string and thus the setting sleeve 18 is directly tied to the outer sleeve 14, as shown in FIG. 1B. Setting sleeve 18 includes a plurality of cones 19 for sliding engagement with the slips 20, and these cones are directly tied to the outer sleeve 14 by the threads 15, as shown in FIG. 2B. Accordingly, the outer sleeve 14 may be lowered from the surface, thereby lowering the setting sleeve 18 relative to the slips 20, and effectively setting the slips. Cam surfaces 21 on the slips and mating cam surfaces on the cone are thus provided for sliding engagement during setting of the slips.

The collets 26 are positioned within the ring body 28 and releaseably engage an annular groove 25 in the mandrel 12 to hold the slips 20 in an upward position, so that the slips do not move downward with the setting cone when the slips are set. Also, internal fluid pressure within the tool otherwise may cause the ring body 28 to move downward. The collets 26 thus open radially outward after the slips are set, as shown in FIG. 5B, and reset the tool when the setting assembly is raised, as shown in FIG. 6B. The action of a collet mechanism is thus repeatable, thereby allowing the tool to be repeatedly restroked. The collets 26 may include upper and lower collet heads 27. Downward movement of the outer sleeve 14 may set the slips 20, and thereafter the slips 20 and the collets 26 may move up relative to the mandrel 12 and the expander 48 during the tool resetting stroke. The inner mandrel 12 of the tool thus moves upward with respect to the set slips 20 during expansion. After the expansion operation, the hydraulic tool may be retracted or reset so tool components return to their same position relative to the expander when the tool was initially at the setting depth.

Another feature of the invention is that the tool, when reaching the upper end of the tubular to be expanded, may set the slips to controllably expand the last section of the tubular, e.g., the upper 5 to 20 feet of the tubular C. The expander 48 will not "shoot" through the top of the tubular in the manner of an expander plug moved by hydraulic force applied directly to the expander, which inherently risks personnel and equipment. Instead, the tool may be reliably stroked hydraulically, with the slips set when the tool controllably passes the expander 48 by the upper end of the tubular.

In the event that the upward pull on the drill string is insufficient to expand a portion of the tubular, the tool of the present invention allows the slips to be set, and the tool hydraulically stroked one or more times, as discussed above, until the expander passes by the cause for the restriction, so that the upward pull on the string can again be used to expand hundreds or thousands of feet of tubular. The customer thus has options if the expander engages a "tight spot," since the tool may be stroked several times to overcome the restriction. The slips may thus be set in the well and the tool stroked so that the expander can reliably pass by an obstruction which resists the substantial tensile force exerted on the expander by the work string. The tensile force of approximately ½ million pounds may thus be exerted on a work string to normally pull the expander through the work string, but a substantially increased force in excess of over 1 million pounds may be generated with the downhole tool to reliably move the expander axially past any tight spot.

The downhole tool as disclosed herein may also be used for a clad or an uncased mono-diameter expansion operation. In this case, the downhole tubular is expanded in engagement with a second tubular that may provide upper support for an uncased tubular expansion, may provide enhanced strength to cased tubulars, or may repair tubulars which may have one or more structural defects or undesirable leaks. A setting operation involves the use of a smaller diameter tubular to be expanded into engagement with the interior of the second tubular, and forms a clad on the interior of the downhole tubular, thereby repairing the second downhole tubular, typically to a structural strength greater than that of the original second tubular.

Figure 11A:
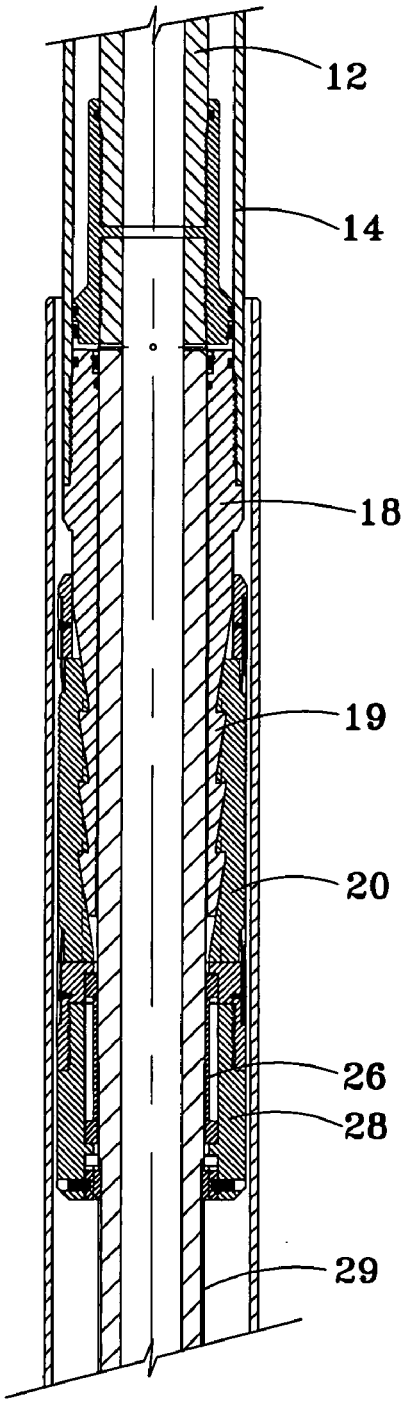
FIGS. 11A and 11B illustrate a portion of an alternative tool with slips above the expander for a clad operation.
Figure 11B:
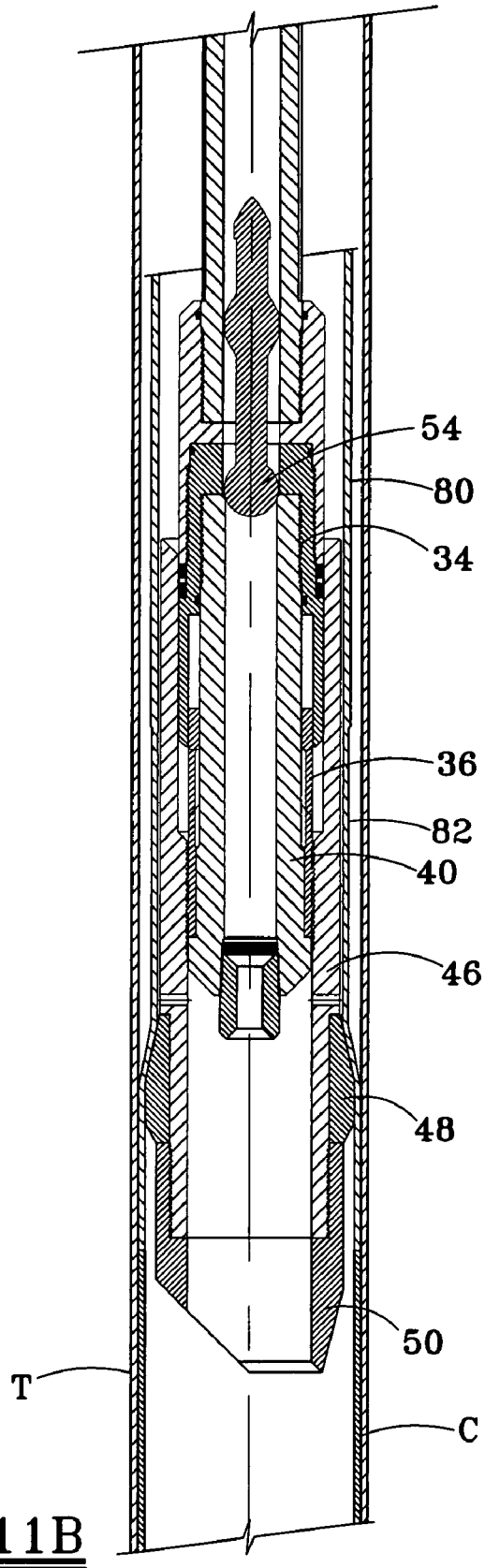

Referring to FIGS. 11A and 11B, one embodiment of the tool provides for the tubular C to be expanded into engagement with a well cased with tubular T during a clad operation. The inner diameter of an upper tubular section 80 is preferably substantially the same as the inner diameter of tubular C prior to expansion, and the lower approximate two feet of tubular has a slightly smaller outside diameter 82 than tubular C. When nearing the uppermost end of the tubular C to be expanded, the slips 20 above the expander 48 may be positioned axially within a portion of the additional tubular section 80, and the slips set as previously discussed to reliably secure the tool in the well. The tool may then be hydraulically stroked so that the expander moves upward from below an uppermost end of the tubular to an expanded position slightly above the uppermost end of the expanded tubular, as shown in FIG. 11B. When the expander reaches the lower end of the additional tubular section 80, which typically has a relatively short length, the upward force on the expander is reliably resisted by the downward force of the set slips 20 inside of the tubular section 80. The position of the setting sleeve 18 and thus the outer sleeve 14 effectively controls the slips to prevent inadvertent unsetting of the slips. A shear pin or other release mechanism may disconnect the tubular section 80 from the expanded tubular C. This procedure thus allows the entire length of the tubular C, including its uppermost end, to be expanded without using a cutting tool or other tool to separate a top unexpanded portion of the tubular 80 from the expanded portion of the tubular C. Once the tubular 80 is released from the expanded tubular C, i.e., by shearing the connecting pins, the entirety of the tubular 80 may be returned to the surface with the tool, while leaving the expanded tubular C in place.

Figure 12:
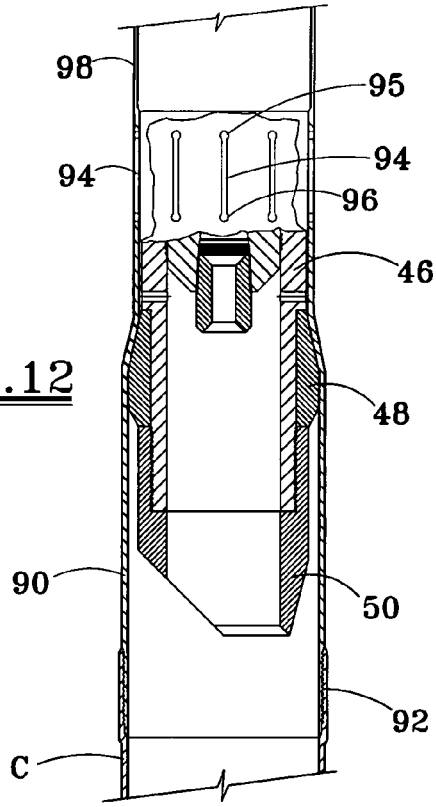
FIG. 12 illustrates the tool expanding a tubular with an expansion control section at the upper end of the tubular.

FIG. 12 discloses a technique for controllably passing the expander 48 by the upper end of a tubular without the risk that the expander will shoot through the top of the tubular. In this case, the tubular C is provided with a short expansion control section or nipple portion 90, which may be threaded to the top of the tubular by threads 92. The lower portion of the section 90 prior to expansion may be substantially the same is cross-section as the tubular C. The upper section is provided with a plurality of elongate slots 94, with each slot having a circular opening 96 at a lower end and a similar circular opening 95 at its upper end. Typical slots may have a length of from 2" to 6", with a ¼" to 1/16" gap prior to expansion. The circular openings substantially reduce the likelihood of the section 90 developing an expansion crack as the expander passes through this section. For this application, the tubular C may be moved upward from a lower portion of the well until the expander is positioned within the upper portion of a well, thereby expanding the tubular. The operator will conventionally be aware of the position of the expander within the casing due to the length of the drill pipe recovered at the surface. When the expander moves upward to the vicinity of the slots 94, the axial force required to move the expander decreases substantially, and the operator at the surface may observe this decrease in tensile load and in response may further slow down the rate of upward travel of the expander through the section 90. The section 98 above the slots may have reduced thickness, so that a further reduced expansion force is required to pass the expander through this reduced thickness section 98. Since the expander has a diameter substantially equal to the unexpanded tubular diameter above the section 90, a still lower force is still required to move the expander through the tubular above the casing C. The expander may thus be passed safely upward through the section 90 while the slips remain unset, with the slots 94 and reduced wall thickness section 98 providing an effective mechanism for reducing the required expansion force while slowing the rate of travel, and thereby reducing the likelihood of the expander shooting past the upper end of the section 90. This technique is particularly well suited when the upper end of the expanded tubular has the same diameter as the tubular above the expanded tubular. Perforations of various configurations may be used instead of the slots, although the perforations preferably are designed to effectively form elongate slots with rib material between adjacent perforations.

Figure 13A:
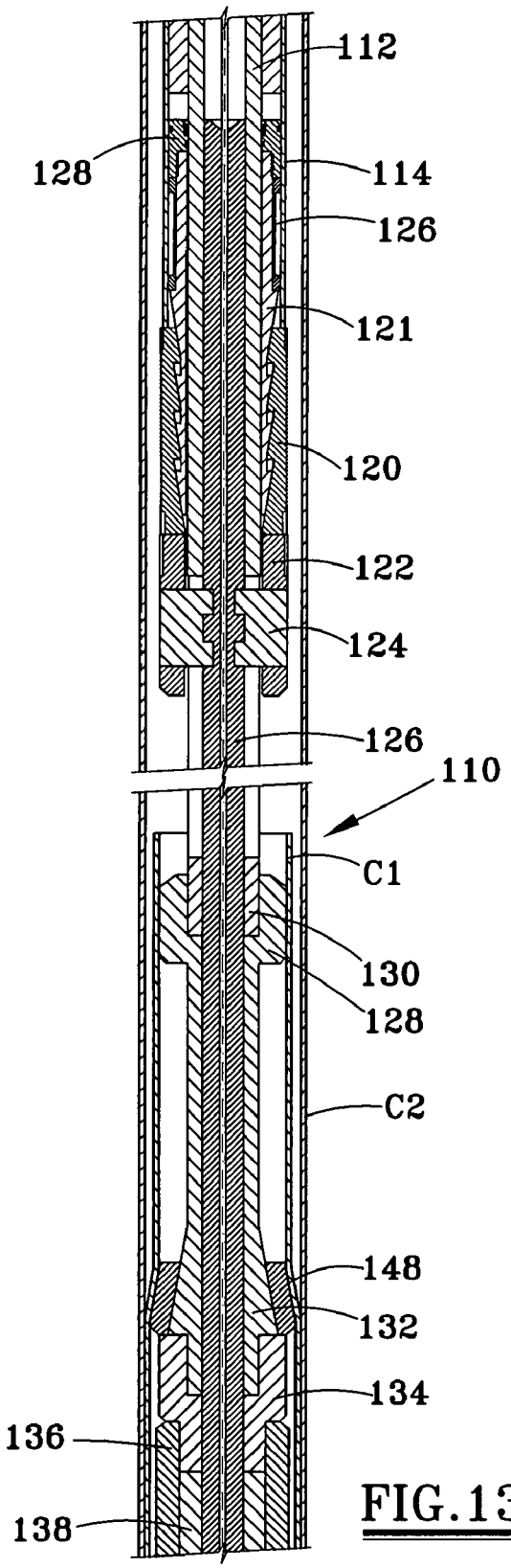
FIGS. 13A and 13B illustrate a portion of another tool with slips both above and below the expander.
Figure 13B:
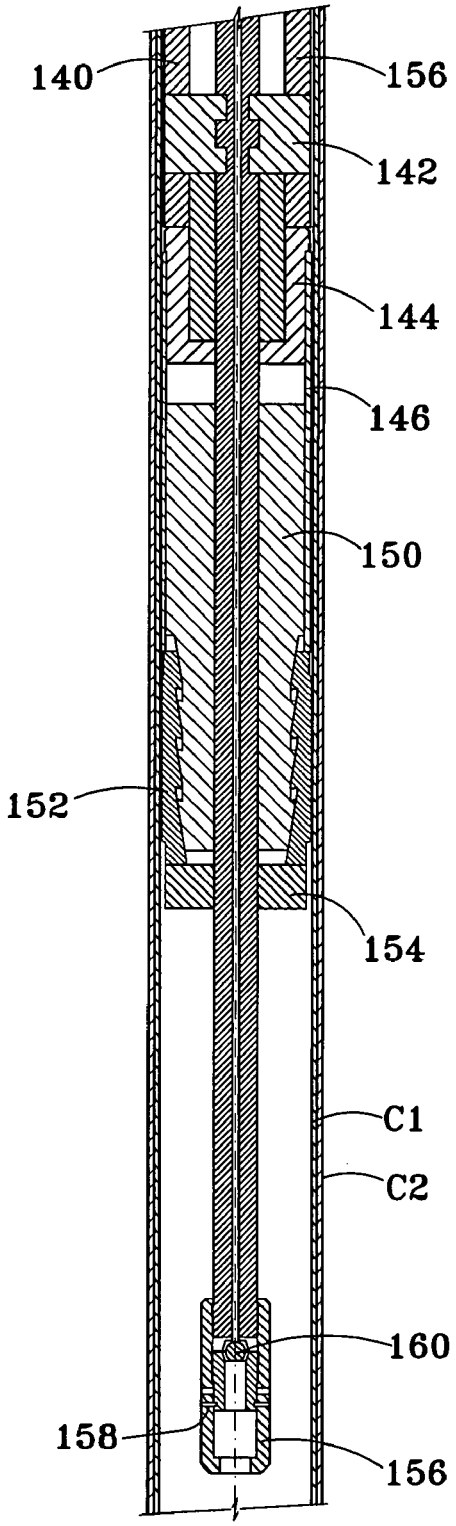

The tool as shown in FIGS. 13A and 13B utilizes an alternate concept for allowing the expander to safely pass through the uppermost end of the tubular to be expanded. For this embodiment, the tool is provided with both upper slips 120 gauged to set in the unexpanded tubular above the expander 128 and lower slips 152 gauged to set in expanded tubular below the expander. During normal operations, the hydraulic actuator tool is stroked and the cam angle for actuating the upper slips causes the upper slips to engage the unexpanded tubular C. The same motion from the actuator tool acts on the lower slips, but the lower slips normally fall short of moving radially outward to engage the internal diameter of the expanded tubular C, since outward movement of the lower slips stops when the upper slips first engage the unexpanded tubular C. When the tool reaches the top of the tubular C to be expanded, as shown in FIG. 13, the tool is expanded and the upper slips move radially outward, but there is no tubular at that axial depth to engage the slips. (Any casing radially outward of the tubular C typically has a diameter too large for engagement with the expanded upper slips.) This same axial stroking of the tool also causes the lower slips to move into engagement with the expanded portion of the tubular C, as shown in FIG. 13B, thereby anchoring the tool below the expander. The expander may then be moved axially upward through an uppermost end of the tubular, the lower slips then released, and the tool returned to the surface.

The tubular expanded by the present invention may have a tension strength and a yield strength which is substantially greater to the unexpanded tubular due to cold working. The tubular may experience a reduction in collapse strength, but that reduction is reasonable and the expanded tubulars are selectively used in applications where the collapse integrity of the expanded tubular is within acceptable limits.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A tool for radially expanding a downhole tubular, comprising:

a tubular expander having a generally tapered outer surface for radially expanding the downhole tubular as the expander is moved upward within the downhole tubular;

a downhole actuator for forcibly moving the expander axially upward within the downhole tubular; and buttress threads on the tubular expander for supporting the tubular expander on the downhole tubular when the expander is run in the well with the downhole tubular, the buttress threads having a tension flank that is substantially perpendicular to or is angled downwardly and radially outwardly with respect to a central axis of the tool, such that the buttress threads support the tubular expander when run in the well and release the tubular expander to move axially upward with respect to the downhole tubular to radially expand the downhole tubular.

2. A tool as defined in claim 1, wherein the tubular expander is positioned at a lowermost end of the downhole tubular when run in a well.

3. A tool as defined in claim 1, wherein the buttress threads solely support the tubular expander from the tubular when the tubular expander and the tubular are run in a well.

4. A tool as defined in claim 1, wherein the downhole actuator comprises the plurality of pistons each axially moveable relative to an inner tool mandrel in response to fluid pressure within the mandrel.

5. A tool as defined in claim 4, wherein at least one of the plurality of pistons is radially inward of another of the plurality of pistons when the downhole actuator is stroked.

6. A tool as defined in claim 1, further comprising:

slips on the tool for securing the tool within the downhole tubular; and the downhole actuator generates an axially downward setting force to set the slips and generates an axially upward tensile force to radially expand the downhole tubular.

7. A tool as defined in claim 6, wherein the slips are disengaged from the downhole tubular by pulling upward on a work string suspending the tool in the well.

8. A tool as defined in claim 1, further comprising:

a sleeve radially within the tubular and axially secured to the tubular expander; and a latch between the sleeve and an inner mandrel of the tool.

9. A tool as defined in claim 1, further comprising:

a sleeve radially within the tubular and axially secured to the tubular expander; and a lower support secured to the sleeve and supporting the expander.

10. A tool for radially expanding a downhole tubular having a substantially uniform diameter cylindrical exterior surface extending to a lower end of the downhole tubular, comprising:

a tubular expander having a tapered outer surface for expanding the downhole tubular as the tubular expander is moved within the downhole tubular, the tubular expander having a radially outermost surface substantially circular in cross-section positioned below the lower end of the downhole tubular when the tubular and the expander are simultaneously run in a well from the surface, the radially outermost surface of the expander when run in the well below the lower end of the downhole tubular having a diameter greater than an initial inner diameter of a substantially cylindrical interior surface of the tubular when run in the well, the expander being positioned below the downhole tubular when the expander and the downhole tubular are simultaneously run in the well; and a downhole actuator for forcibly moving the expander axially upward within the downhole tubular, the downhole actuator generating an axially downward setting force to set slips aqainst the downhole tubular and subsequently generates an axially upward tensile force to radially expand the downhole tubular.

11. A tool as defined in claim 10, wherein the downhole actuator comprises a plurality of pistons each axially moveable relative to an inner mandrel of the tool in response to fluid pressure.

12. A tool as defined in claim 10, wherein the tapered outer surface of the tubular expander is angled at from 9° to 15° relative to an axis of the downhole tubular.

13. A tool as defined in claim 10, further comprising:

a sleeve radially within the tubular above the expander and axially secured to the tubular expander; and a latch between the sleeve and an inner mandrel of the tool for repeatedly connecting and disconnecting the sleeve and the inner mandrel.

14. A method of radially expanding a downhole tubular having a substantially uniform diameter cylindrical exterior surface extending to a lower end of the downhole tubular, comprising:

positioning a tool with a tubular expander having a tapered outer surface on the lower end of the tubular;

running the tubular and the tubular expander simultaneously in a well while the tubular expander is positioned below the lower end of the tubular;

the tubular expander having a radially outermost surface positioned below the lower end of the downhole tubular when the tubular expander is run in the well, the radially outermost surface having a diameter greater than an initial inner diameter of a substantially cylindrical interior surface of the tubular when the expander and the downhole tubular are run in the well, the tubular expander being positioned below the downhole tubular when the expander and the downhole tubular are run in the well;

positioning slips on the tool for securing the tool within the downhole tubular;

a downhole actuator generates an axially downward setting force to set the slips and generates an axially upward tensile force to radially expand the downhole tubular; and using the downhole actuator within the well to forcibly move the expander axially within the downhole tubular.

15. A method as defined in claim 14, wherein the tubular expander is positioned at the lower end of the downhole tubular on buttress threads when run in the well.

16. A method as defined in claim 14, further comprising:

providing a latch for latching the tubular expander to a sleeve radially within the tubular and axially secured to the tubular expander for repeatedly connecting and disconnecting the sleeve and the inner mandrel.

17. A method as defined in claim 15, wherein positioning the slips comprises:

providing upper slips on the tool above the tubular expander for securing the tool within the downhole tubular; and providing lower slips on the tool below the tubular expander for securing the tool within the downhole tubular.

18. A tool for radially expanding a downhole tubular having a substantially uniform diameter cylindrical exterior surface extending to a lower end of the downhole tubular, comprising:

a single-piece, rigid, ring-shaped tubular expander having a generally tapered outer surface for radially expanding the downhole tubular as the expander is moved within the downhole tubular, the single-piece, rigid, ring-shaped tubular expander being run in a well below the downhole tubular to be expanded when the tubular and the tubular expander are simultaneously run in the well from the surface;

a downhole actuator for forcibly moving the expander axially within the downhole tubular;

slips positioned above the tubular expander for securing the tool to the downhole tubular;

the downhole actuator generates an axially downward setting force to set the slips and generates an axially upward tensile force to radially expand the downhole tubular; and the tool transferring an axial force from a work string extending to the surface to the tubular expander to radially expand the downhole tubular when the slips are unset.

19. A tool as defined in claim 18, wherein the downhole actuator comprises a plurality of pistons each axially moveable in response to fluid pressure relative to an inner tool mandrel.

20. A tool as defined in claim 18, wherein buttress threads support the tubular expander from the lower end of the tubular when the tubular expander and the tubular are run in the well.

21. A tool as defined in claim 18, wherein the slips are disengaged from the downhole tubular by pulling upward on the work string suspending the tool in the well.

22. A tool as defined in claim 18, further comprising:

a sleeve radially within the tubular above the expander and axially secured to the tubular expander; and a latch between the sleeve and an inner mandrel of the tool for repeatedly connecting and disconnecting the sleeve and the inner mandrel.

23. A tool as defined in claim 18, further comprising:

a sleeve radially within the tubular and axially secured to the tubular expander; and a lower support secured to the sleeve and supporting the expander.

24. A method of radially expanding a downhole tubular having a substantially uniform diameter cylindrical exterior surface extending to a lower end of the downhole tubular, comprising:

providing a central tool mandrel;

providing a single-piece, rigid, ring-shaped tubular expander having a tapered outer surface substantially circular in cross-section for expanding the downhole tubular as the expander is moved axially within the downhole tubular, the single-piece, rigid, ring-shaped tubular expander being run in the well below the downhole tubular to be expanded when the tubular and the tubular expander are simultaneously run in a well from the surface of the well;

positioning slips about the tool mandrel for securing to the downhole tubular;

activating a downhole actuator to generate a downward setting force to set the slips;

activating the downhole actuator to generate an upward tensile force to axially move the expander within the downhole tubular and expand a portion of the downhole tubular; and thereafter releasing the slips and transferring axial tension from a work string through the tool mandrel and to the tubular expander to expand another portion of the downhole tubular.

25. A method as defined in claim 24, wherein the downhole actuator comprises a plurality of pistons each axially moveable relative to the inner mandrel of the tool in response to fluid pressure.

26. A method as defined in claim 24, further comprising:

supporting the tubular expander from the tubular on buttress threads when the tubular expander and the tubular are run in the well.

27. A method as defined in claim 24, wherein positioning slips about the tool mandrel include:

positioning upper slips about the tool mandrel and above the tubular expander; and positioning lower slips about the tool mandrel and below the tubular expander, such that the downhole actuator generates the setting force to cause at least one of the upper and lower slips to engage the downhole tubular in the well.

28. A method as defined in claim 27, wherein the downhole actuator operates both the upper slips and the lower slips, and setting of the slips is controlled for selectively engaging one of the upper and lower slips with the tubular.

29. A tool for radially expanding a downhole tubular, comprising:

a tubular expander having a generally tapered outer surface for radially expanding the downhole tubular as the expander is moved within the downhole tubular;

a downhole actuator for forcibly moving the expander axially within the downhole tubular;

slips positioned above the tubular expander for securing the tool within the downhole tubular;

a collet mechanism for controlling axial movement of the slips relative to a mandrel radially within the slips, such that the slips engage a stop surface on the mandrel to prevent the slips from moving downward when the slips are set and the slips move upward relative to the mandrel when the tool is restroked by the downhole actuator; and buttress threads support the tubular expander on the tubular when the tubular expander and the tubular are run in a well.

30. A tool as defined in claim 29, wherein the tubing expander is positioned at a lowermost end of the downhole tubular when the tubular and the tubular expander are simultaneously run in the well.

31. A tool as defined in claim 29, wherein the slips are disengaged from the downhole tubular by pulling upward on a work string suspending the tool in the well.

32. A tool for radially expanding a downhole tubular having a substantially uniform diameter cylindrical exterior surface extending to a lower end of the downhole tubular, comprising:

a tubular expander having a tapered outer surface for expanding the downhole tubular as the tubular expander is moved within the downhole tubular, the tubular expander having a radially outermost surface substantially circular in cross-section positioned below the lower end of the downhole tubular, the radially outermost surface of the expander when run in the well having a diameter greater than an initial outer diameter of the tubular, the expander being positioned below the downhole tubular when the expander and the downhole tubular are simultaneously run in a well from the surface of the well;

a downhole actuator for forcibly moving the expander axially upward within the downhole tubular, the downhole actuator comprising a plurality of pistons each axially movable relative to an inner mandrel of the tool in response to fluid pressure to generate an axially downward setting force to set slips against the downhole tubular and subsequently generate an axially upward tensile force to radially expand the downhole tubular; and the downhole actuator generating an axially downward setting force to set slips and subsequently generating an axially upward tensile force to radially expand the downhole tubular.

33. A tool as defined in claim 32, wherein the tapered outer surface of the tubular expander is angled at from 9° to 15° relative to an axis of the downhole tubular.

34. A tool as defined in claim 32, further comprising:

a sleeve radially within the tubular and axially secured to the tubular expander; and a latch between the sleeve and an inner mandrel of the tool.

35. A method of radially expanding a downhole tubular having a substantially uniform diameter cylindrical exterior surface extending to a lower end of the downhole tubular, comprising:

positioning a tubular expander having a tapered outer surface on a lower end of the tubular;

running the tubular and the tubular expander simultaneously in a well;

the tubular expander having a radially outermost surface positioned below a lower end of a downhole tubular when the tubular expander and the tubular are simultaneously run in the well, the radially outermost surface having a diameter greater than an initial outer diameter of the tubular when the expander and the downhole tubular are run in the well from the surface, the tubular expander being positioned below the downhole tubular when the expander and the downhole tubular are run in the well from the surface of the well;

positioning a downhole actuator within the well for forcibly moving the expander axially within the downhole tubular;

the downhole actuator comprising a plurality of pistons each axially moveable relative to an inner mandrel of the tool in response to fluid pressure;

and the downhole actuator generates an axially downward setting force to set slips and generates an axially upward tensile force to radially expand the downhole tubular.

36. A method as defined in claim 35, wherein the tubular expander is positioned at the lower end of the downhole tubular on buttress threads when run in the well.

37. A method as defined in claim 35, further comprising:

providing a latch for latching the tubular expander to a sleeve radially within the tubular and axially secured to the tubular expander.

38. A method as defined in claim 35, further comprising:

providing upper slips on the tool above the tubular expander for securing the tool within the downhole tubular, and providing lower slips on the tool below the tubular expander for securing the tool within the downhole tubular.

* * * * *